US006234939B1

(12) United States Patent
Moser et al.

(10) Patent No.: US 6,234,939 B1
(45) Date of Patent: May 22, 2001

(54) UNIPEDAL CYCLE APPARATUS

(76) Inventors: Thomas V. Moser, 20 Washington Pl.; Nicholas James Vailas, 71 Sandy Pond Pkwy., both of Bedford, NH (US) 03110; Virginia L. Ross, 671 Post Rd., Greenland, NH (US) 03842; Andrew John Bolduc, 54 Harris St., Methuen, MA (US) 01844

( * ) Notice: Subject to any disclaimer, the term of this patent is extended or adjusted under 35 U.S.C. 154(b) by 565 days.

(21) Appl. No.: 08/591,801

(22) Filed: Jan. 25, 1996

(51) Int. Cl.[7] ..... A63B 22/06; A63B 21/00
(52) U.S. Cl. ..... 482/63; 482/57
(58) Field of Search ..... 482/51, 52, 53, 482/57, 63, 62

(56) References Cited

U.S. PATENT DOCUMENTS

| | | | | |
|---|---|---|---|---|
| 334,635 | * | 1/1886 | Bowen | 482/64 |
| 4,358,105 | * | 11/1982 | Sweeney | 482/64 |
| 4,477,072 | * | 10/1984 | De Cloux | 482/52 |
| 4,705,493 | * | 11/1987 | Lin | 482/64 |
| 4,708,128 | * | 11/1987 | Ancillotti | 482/57 |
| 4,923,193 | * | 5/1990 | Pitzen et al. | 482/63 |
| 5,139,255 | * | 8/1992 | Sollami | 482/62 |
| 5,433,680 | * | 7/1995 | Knudsen | 482/63 |
| 5,496,238 | * | 3/1996 | Taylor | 482/57 |

* cited by examiner

*Primary Examiner*—Stephen R. Crow
(74) *Attorney, Agent, or Firm*—William B. Ritchie

(57) ABSTRACT

The present invention utilizes a split hub assembly that provides the user two modes of operation, unipedal or bipedal. Unipedal mode is when each crank is functioning independent of the other thus forcing the user to work each leg differently yet simultaneously. Bipedal simulates the normal operation of a bicycle. In the preferred embodiment, each side of the invention (left and right side for left and right legs) has its own drive system. The split hub assembly is housed between each drive system, and by using an actuator, the drive systems can be connected to provide bipedal operation, or disconnected to provide unipedal operation. This allows each side, in unipedal mode, to vary its resistance without affecting the other side in order for a patient to exercise both legs separately and favor one with a different resistance to account for an injury or recovery from surgery. The friction brakes for each drive system are controlled by a microprocessor that turns the motors in the required direction for either increasing or decreasing the tension on the brake belt. The microprocessor monitors power and performance and regulates the resistance levels to deliver either isotonic or isokinetic resistance. The resistance in bipedal mode is varied in the same manner, but the resistance is equal on each leg.

20 Claims, 10 Drawing Sheets

UNIPEDAL CYCLE APPARATUS

BACKGROUND OF THE INVENTION

1. Field of the Invention

The invention relates to bicycles for exercise and/or therapeutic purposes.

2. Description of the Related Art

The bicycle has been tremendously successful not only as a form of transportation, but for exercise purposes as well. The term bicycle used in this context includes road bikes as well as stationary bikes. In the marketplace, road bikes and stationary bikes have proven to be extremely successful. Literally tens of millions of both road bikes and stationary bikes are used on a regular basis which demonstrates not only the popularity of the bicycle as a machine per se, but also the general interest of the population in using machines for exercise, conditioning and therapeutic purposes.

In this regard, the proliferation and success of a myriad of exercise machines has been extensive over the last two decades. This proliferation coincides with an increased awareness in the community of health consciousness, physical conditioning, and a sense of well-being from exercise.

The road bike and stationary bike, however, have remained a very popular alternative for exercise and rehabilitation. There have been no significant technological or structural changes to the bicycle over the past decades. Inherent in the concept of the bicycle as a machine is the creation of efficiency, i.e., to reduce the workload required to perform a certain function. The stationary bicycle continues to use a single drive sprocket (may or may not include a flywheel) joined by a single axle having two cranks coupled 180 degrees out of phase with each other while utilizing various types of resistance. The resistance and work output are related to the amount of resistance applied to the cranks. Of great interest to the exercise community, both for exercise and therapeutic purposes, is the ability to maximize work output per unit time. An example of an attempt to expand work output as well as expanding the physical demands on an increased number of muscles can be seen in an aerodyme bike. The aerodyme bike requires pedaling while simultaneously exercising the upper body with the use of crank arms.

In reference to the muscles worked during bicycling, the extensor muscles, i.e., the quadriceps and hip extensors are essentially emphasized. During pedaling, most of the work output is created on the downstroke with momentum while the opposite pedal takes the leg through the upstroke with a much reduced work demand. Experienced professional riders learn to push and pull to maximize their workload during short bursts, but even in this regard, the upstroke pedal is still assisted by the opposite downstroke pedal.

Herein is where the deficiency lies. When someone with an injury in one leg wants to use a road bike or a stationary bike, one leg is dependent on the other because normal bicycles are bipedal. In other words, the injured leg can not be independently worked without the use of the other leg. Furthermore, current bicycle operations are efficient while only working specific muscle groups in the leg. Hence, the user does not have an option to simultaneously exercise both the agonist and antagonist muscles through the cycle of rotation, i.e., quad and hamstrings, hip flexors and hip extenders.

It would be an improvement on the current art to create a unipedal cycle wherein each leg's movement is independent of the other. This aspect would serve to expand the effectiveness of bicycling in reconditioning of an injured leg. Independent operation of the legs would also increase the work output demands per unit time but not at the expense of overstressing the joints, muscles and soft tissues. It would be counterproductive if additional injuries were created. A device that overcomes the shortcomings as just described for a road bike or stationary bike is not disclosed in the prior art.

SUMMARY OF THE INVENTION

It an aspect of the invention to provide a unipedal cycle apparatus wherein the movement of each leg is independent of the other.

It is another aspect of the invention to provide a unipedal cycle apparatus that can be alternatively bipedaling.

It is another aspect of the invention to provide a unipedal cycle apparatus where both legs must work fully throughout each pedal revolution.

It is another aspect of the invention to provide a unipedal cycle apparatus that has the ability to work each leg independently.

It is another aspect of the invention to provide a unipedal cycle apparatus that increases work output over bipedal cycles.

It is another aspect of the invention to provide a unipedal cycle apparatus that increases work output without overstressing the joints, muscles and soft tissues.

It is another aspect of the invention to provide a unipedal cycle apparatus that is used for exercise purposes.

It is another aspect of the invention to provide a unipedal cycle apparatus that is used for conditioning.

It is another aspect of the invention to provide a unipedal cycle apparatus that is used for therapeutic purposes.

It is another aspect of the invention to provide a unipedal cycle apparatus that provides isotonic (same force) resistance.

It is another aspect of the invention to provide a unipedal cycle apparatus that provides isokinetic (same speed) resistance.

It is another aspect of the invention to provide a unipedal cycle apparatus that specifically addresses aerobic repetitive cyclic exercising of the hamstrings.

It is another aspect of the invention to provide a unipedal cycle apparatus that specifically addresses aerobic repetitive cyclic exercising of the hip flexors.

It is another aspect of the invention to provide a unipedal cycle apparatus that works the hamstrings and hip flexors on the upstroke of the pedaling motion.

It is another aspect of the invention to provide a unipedal cycle apparatus that increases muscle strength without the risk of tightening and overstrengthing.

It is another aspect of the invention to provide a unipedal cycle apparatus that does not promote muscle injury.

It is another aspect of the invention to provide a unipedal cycle apparatus that works the abdominals muscles.

It is another aspect of the invention to provide a unipedal cycle apparatus to exercise both the agonist and antagonist muscles through the cycle of rotation. i.e., quad and hamstrings, hip flexors and hip extenders.

It is another aspect of the invention to provide a unipedal cycle apparatus that is inherently safe.

It is another aspect of the invention to provide a unipedal cycle apparatus that is user friendly.

It is another aspect of the invention to provide a unipedal cycle apparatus that has an adjustable crank arm to lessen or increase the range of motion of the leg in pedaling.

It is another aspect of the invention to provide a unipedal cycle apparatus that has adjustable pedals to alter demands on the different muscles being exercised.

It is another aspect of the invention to provide a unipedal cycle apparatus that has an adjustable seat that be adjusted vertically thereby allowing for a variation of leg length and that be adjusted horizontally thereby allowing for different positioning fore and aft relative to the hub.

It is another aspect of the invention to provide a unipedal cycle apparatus that is adaptable to any variety of resistance methods such as electromagnetic, friction belt, disc brake and hydraulic and a variety of resistance controls such as isotonic and isokinetic.

It is another aspect of the invention to provide a unipedal cycle apparatus that works each leg indendently with varying resistance.

It is a final aspect of the invention to provide a unipedal cycle apparatus that can be applied to either a stationary or road bicycle.

The invention is a pedal apparatus having a left pedal attached to a left crank and a right pedal attached to a right crank wherein the pedal apparatus comprises a left drive system connected to the left crank and a right drive system connected to the right crank such that the left drive system is substantially identical to the right side drive system and wherein a pedalling resistance on the left pedal can be set independently of a pedalling resistance on the right pedal. The pedal apparatus further comprises a split hub assembly having two central axles, wherein one axle is connected to the left side drive system and the other axle is connected to the right side drive system, such that the split hub assembly is selectively operable by the user as a bipedal apparatus having the left pedal and the right pedal rotating synchronously thus causing the invention to behave as a standard pedal apparatus. The split hub assembly utilizes a plunger and an activation rod wherein the user activates the rod to cause the plunger to lock together the right and left drive assemblies whereby the left pedal and the right pedal rotate synchronously. The drive system further comprises a left brake system whereby the brake system provides resistance to the left drive system and a right brake system whereby the right brake system provides resistance to the right drive system. An electronics module independently reads encoded data from the left drive system and from the right drive system whereby the data is translated into measurements of power, distance traveled and speed.

DETAILED DESCRIPTION OF THE INVENTION

Figure 1:
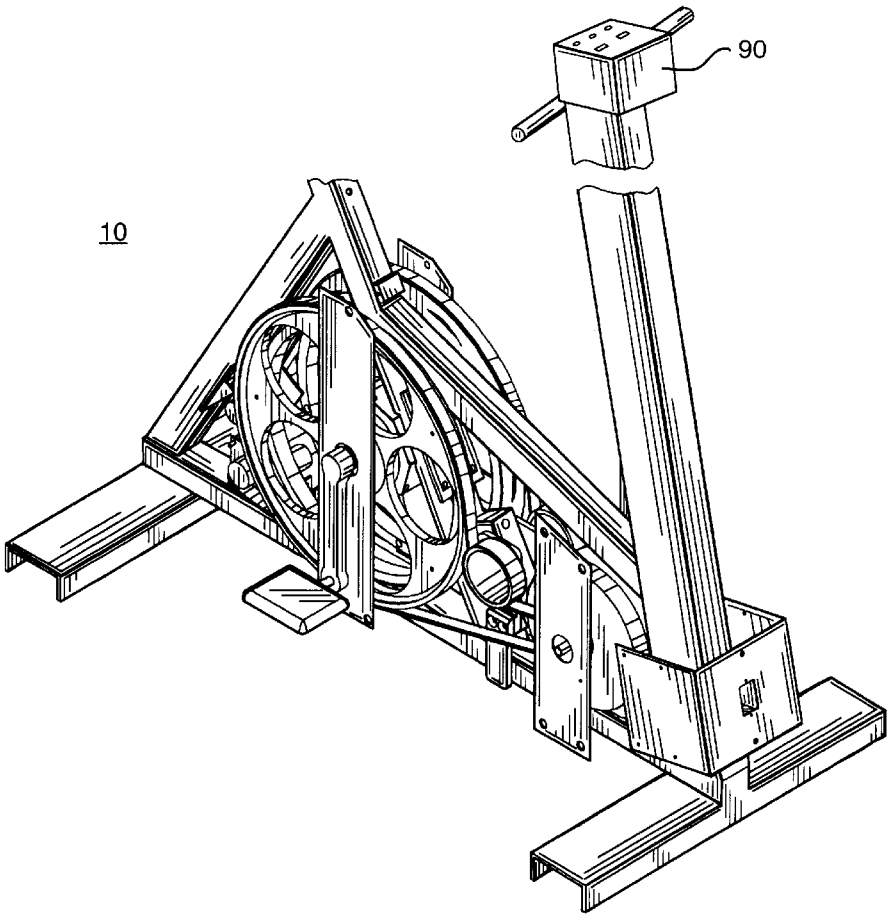
FIG. 1 is an isometric view of a stationary unipedal cycle apparatus.

FIG. 1 is an isometric view of stationary unipedal cycle apparatus 10. In the preferred embodiment, each side of stationary unipedal cycle apparatus 10 has its own pedal, crank, drive system and flywheel. The present invention utilizes a split hub assembly to give it the ability to offer two modes of operation: unipedal or bipedal. Unipedal mode is when each crank is functioning independent of the other. Bipedal simulates the normal operation of a bicycle.

In addition to the concept of apparatus 10 being applied to the stationary bike as described herein, the unipedaling concept can also be applied to a road bike. The concept of the foot pedal and foot crank provides the user independent leg resistance for a tailored exercise/rehabilitation program can likewise be extended to the user's arms via the addition an arm pedal and arm crank to provide the user independent arm resistance for a tailored exercise/rehabilitation program while simultaneously exercising the legs. In other words, apparatus 10 could be configured as an aerodyme bike, except with the added benefit of the user's legs and arms being able to be independently worked with a varying resistance applied to each crank.

Figure 2:
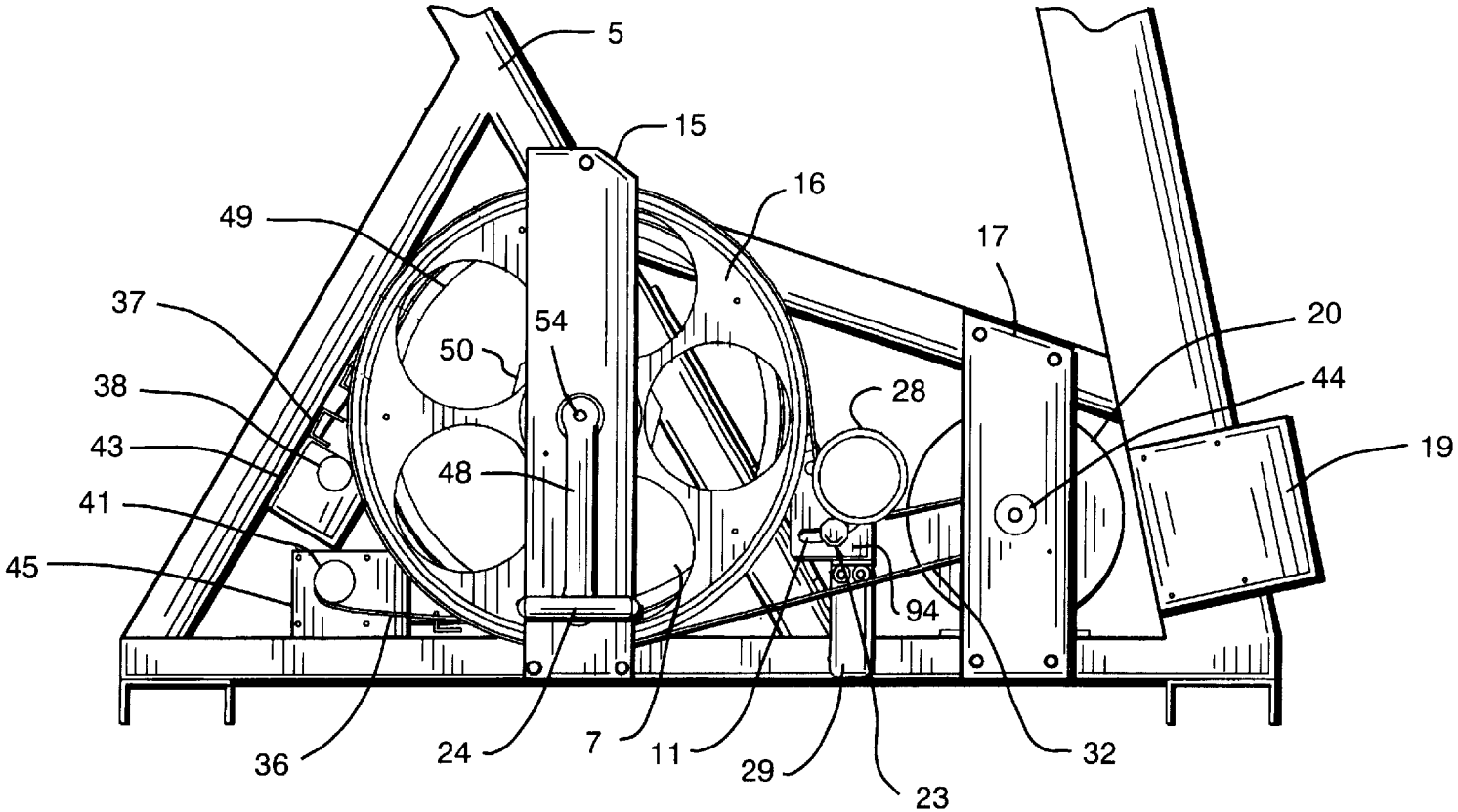
FIG. 2 is a right side view of the stationary unipedal cycle apparatus.

FIG. 2 is a right side view of stationary unipedal cycle apparatus 10. When describing operation of the drive system of apparatus 10, forward motion will be considered in a clockwise direction when looking at apparatus 10 form the right side. This forward motion applies energy directly into apparatus 10. A counter-clockwise motion does not apply energy into apparatus 10.

All components of the invention are mounted to support frame 5. Support Frame 5 is made out of tubular steel. The drive system components for the right side are functionally identical to the drive system components of the left side except for axles 60/62 and plunger 52, which will be discussed in greater detail within the following paragraphs. Drive system components for the right side consist of the following items: pedal 24, crank 48, drive sheave 16, drive belt 32, idler pulley 28, idler tensioner 94, flywheel 20 and flywheel sheave 44. Drive sheave 16 has a seventeen inch diameter and is constructed out of aluminum. Circular cut-outs 7 in drive sheave 16 help to reduce the overall weight of apparatus 10. Drive belt 32 is an eight rib PolyV belt. The diameter of the remaining components, where applicable, are two and one half inches for idler pulley 28, eight inches for flywheel 20 which is constructed out of cast steel, and two inches for flywheel sheave 44.

An applied force on right pedal 24 turns crank 48 in a clockwise direction. Crank 48 is affixed to right axle 62 of split hub assembly 100. An adjustable pedal 24 would allow the user to alter demands on the different muscle groups being exercised. Also, an adjustable crank 48 would allow the user to lessen or increase the range of motion of the limb in pedaling. An adjustable seat (not shown) to apparatus 10 would not only allow a variation of the user's leg length, but also in the possible positions over pedals 22/24, thus changing the movements and demands of the user while pedaling.

A detailed description of split hub assembly 100 and its components will be discussed within when reference is made to FIG. 4. As right axle 62 is turned about its axis of rotation in the forward clockwise direction, roller clutch bearings 64 (reference FIG. 4) are engaged to rotate right drive sheave 16 about the same axis. Drive belt 32 is wrapped tightly around drive sheave 16, idler pulley 28 and flywheel sheave 44. As drive sheave 16 moves forward, drive belt 32 rotates flywheel sheave 44 in a clockwise direction, which likewise rotates flywheel 20 in a clockwise direction. A forward moving drive belt 32 serves to rotate right flywheel 20 at a ratio of 8.5 to 1.

Two optical encoder disks 63 and 65 are used to provide optical data for the onboard electronics; right axle encoder disk 63 is located on the outboard side of right axle 62 while right flywheel encoder disk 65 is located on the outboard side of flywheel 20. Optical encoders 63 and 65 are not shown in FIG. 2 due to their positioning behind front and rear protective encoder shields 15 & 17. Because of the symmetry between the right and left sides of apparatus 10, a representation of optical encoder disks 63 and 65 can be seen in FIG. 3 by referencing left axle encoder disk 66 and left flywheel encoder disk 67. The left side protective encoder shields have been removed for the purpose of illustrating location of optical encoder disks 66 and 67.

Idler puller 28 serves to provide continuity between drive sheave 16 and flywheel sheave 44 by allowing tensioning adjustment to drive belt 32. Tension is increased to drive belt 32 by loosening tensioner nut 23 and rotating tensioner handle 29 in a clockwise direction until the desired tension level is reached. Tightening tensioner nut 23 ensures that the tension in drive belt 32 is maintained. Machined slot 11 in idle tensioner 94 allows for adequate adjustment. Idler pulley 28 is affixed to a frictionless bearing which encloses a small shaft (not shown) that is part of idler tensioner 94. The entire assembly is fastened to diagonal cross member 6 of apparatus support frame 5.

The brake system of apparatus 10 utilizes a resistance that is provided to the right side drive system via friction band brake 36. As brake band 36 is tightened, the torque required to rotate drive sheave 16 is increased. Brake band 36 is wrapped around brake rim 49. Brake rim 49 is a fifteen inch diameter by three quarter inch wide aluminum rim fastened to the inside of drive sheave 16 such that the two rotate as one unit. One end of brake band 36 is fastened to brake cylinder 41. Brake cylinder 41 is an aluminum cylinder centered around and secured to the shaft of right DC gear motor 40 (shown in FIG. 3). The opposite end of brake band 36 is fastened securely to an adjustable brake band anchor 37. Anchor 37 can be adjusted with a tensioner screw (not shown) to provide fine changes in brake band tension. Anchor 37 is attached to left motor support bracket 43. When right gear motor 40 shaft is rotated clockwise by an electrical signal, brake cylinder 41 is also rotated clockwise, thus causing brake band 36 to tightened around brake rim 49/drive sheave 16.

Figure 3:
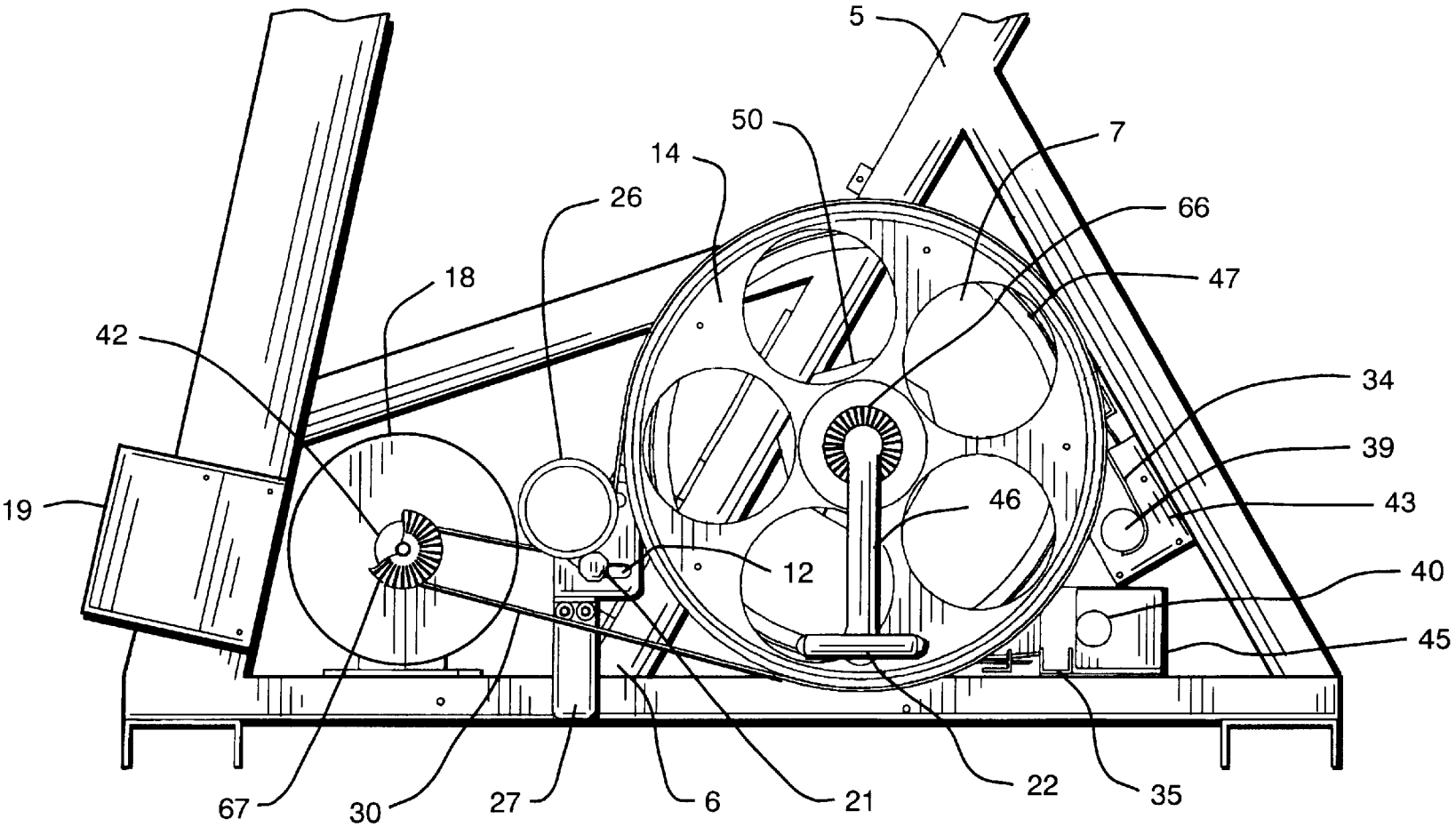
FIG. 3 is a left side view of the stationary unipedal cycle apparatus with the front and rear encoder protective shields removed.

FIG. 3 is a left side view of stationary unipedal cycle apparatus 10 with the front and rear protective shields removed. All left side components are functionally identical to the right side components, except for axles 60 and 62 and plunger 52, which will be described in greater detail when reference is made to FIG. 4. When describing operation of the left drive system of apparatus 10 as viewed from the left side, forward motion is in a counter-clockwise direction. Thus, forward motion is opposite that of the direction as viewed from the right side. This forward motion applies energy directly into apparatus 10. A clockwise motion does not apply energy into apparatus 10.

The drive system components for the left side consist of the following: pedal 22, crank 46, drive sheave 14, drive belt 30, idler pulley 26, idler tensioner 94, flywheel 18 and flywheel sheave 42. Drive sheave 14 has a seventeen inch diameter and is constructed out of aluminum. Circular cut-outs 7 in drive sheave 14 help to reduce the overall weight of apparatus 10. Drive belt 30 is an eight rib PolyV belt. The diameter of the remaining components, where applicable, are two and one half inches for idler pulley 26, eight inches for flywheel 18 which is constructed out of cast steel, and two inches for flywheel sheave 42.

An applied force on left pedal 22 turns crank 46 in a counter-clockwise direction. Crank 46 is affixed to left axle 60 of split hub assembly 100. An adjustable pedal 22 would allow the user to alter demands on the different muscle groups being exercised. Also, an adjustable crank 46 would allow the user to lessen or increase the range of motion of the limb in pedaling. An adjustable seat (not shown) to apparatus 10 would not only allow a variation of the user's leg length, but also in the possible positions over pedals 22/24, thus changing the movements and demands of the user while pedaling.

A detailed description of split hub assembly 100 and its components will be discussed within when reference is made to FIG. 4. As left axle 60 is turned about its axis of rotation in the forward counter-clockwise direction, roller clutch bearings 64 (reference FIG. 4) are engaged to rotate left drive sheave 14 about the same axis. Drive belt 30 is wrapped tightly around drive sheave 14, idler pulley 26 and flywheel sheave 42. As drive sheave 14 moves forward, drive belt 30 rotates flywheel sheave 42 in a counter-clockwise direction, which likewise rotates flywheel 18 in a counterclockwise direction. A forward moving drive belt 30 serves to rotate left flywheel 18 at a ratio of 8.5 to 1.

Two optical encoder disks 66 and 67 are used to provide optical data for the onboard electronics; left axle encoder disk 66 is located on the outboard side of left axle 60 while left flywheel encoder disk 67 located on the outboard side of flywheel 18. The left side encoder shields have been removed for the purpose of illustrating location of the optical encoder disks. With the left shields in place, they are identical to front and rear protective encoder shields 15 & 17, as shown in FIG. 2.

Idler puller 26 serves to provide continuity between drive sheave 14 and flywheel sheave 42 by allowing tensioning adjustment to drive belt 30. Tension is increased to drive belt 30 by loosening tensioner nut 21 and rotating tensioner handle 27 in a counterclockwise direction until the desired tension level is reached. Tightening tensioner nut 21 ensures that the tension in drive belt 30 is maintained. Machined slot 12 in idler tensioner 92 allows for adequate adjustment. Idler pulley 26 is affixed to a frictionless bearing which encloses a small shaft (not shown) that is part of the idler tensioner 92. The entire assembly is fastened to diagonal cross member 6 of apparatus support frame 5.

The brake system of apparatus 10 utilizes a resistance that is provided to the left side drive system via a friction band brake. As brake band 34 is tightened, the torque required to rotate drive sheave 14 is increased. Brake band 34 is wrapped around brake rim 47. Brake rim 47 is a fifteen inch diameter by three quarter inch wide aluminum rim fastened to the inside of drive sheave 14 such that the two rotate as one unit. One end of brake band 34 is fastened to brake cylinder 39. Brake cylinder 39 is an aluminum cylinder centered around and secured to the shaft of a DC gear motor 38 (shown in FIG. 2). The opposite end of brake band 34 is fastened securely to an adjustable brake band anchor 35. Anchor 35 can be adjusted with a tensioner screw (not shown) to provide fine changes in brake band tension. Anchor 35 is attached to right motor support bracket 45. When left gear motor 38 shaft is rotated clockwise by an electrical signal, brake cylinder 39 is also rotated clockwise, thus causing brake band 34 to tightened around brake rim 47/drive sheave 14.

Electrical signals are sent to gear motors 38 and 40 from a printed circuit board located beneath power shield 19. Layout of the printed circuit board is well known in the art. These signals are the direct result of a computer-controlled function to increase or decrease the resistance in drive sheaves 14/16. The rider controls the application and magnitude of the resistance with entry buttons located on display console 90. The rider may also choose to independently adjust resistance to one side or the other, or simultaneously adjust resistance to both drive sheaves 14/16.

Figure 4:
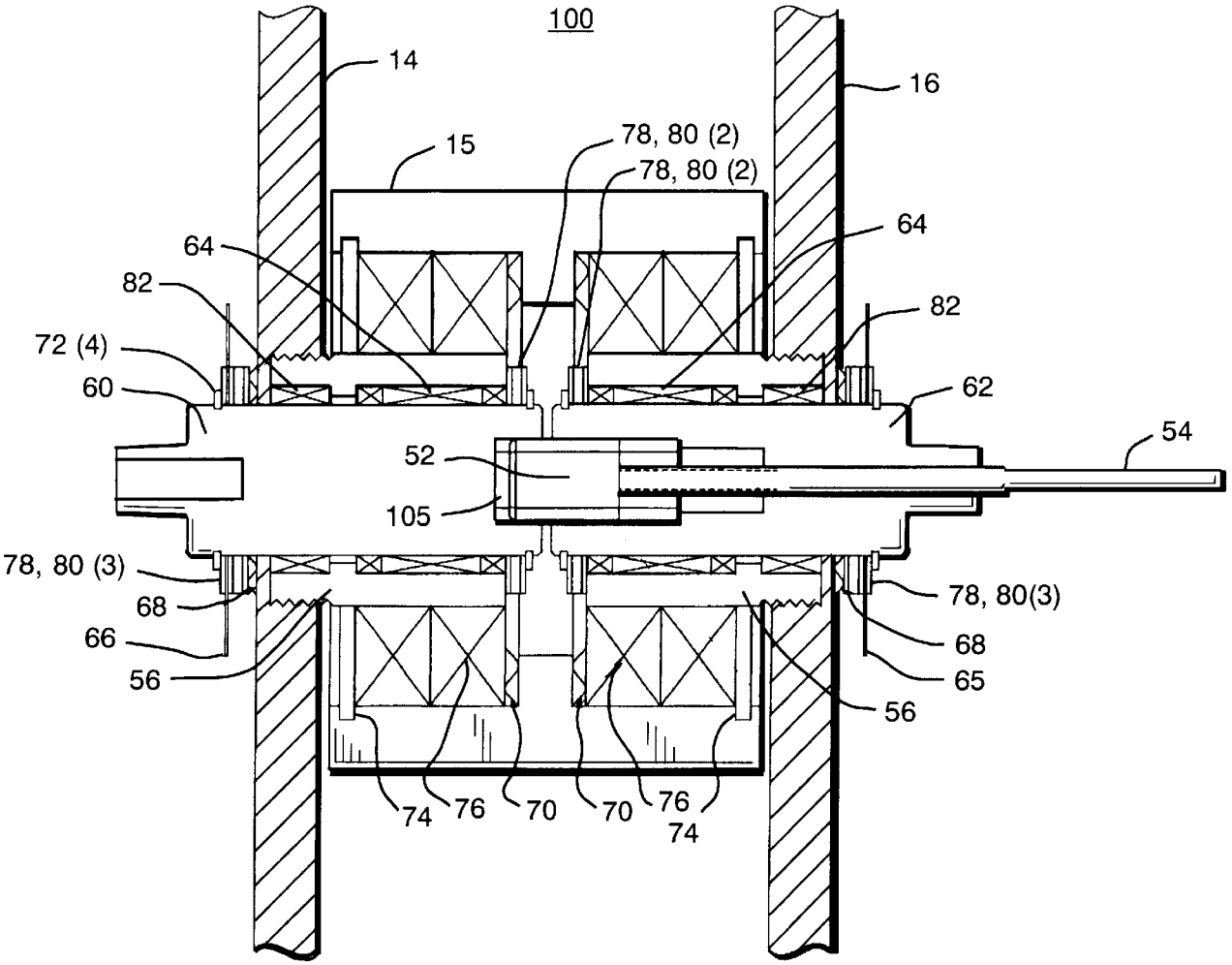
FIG. 4 is an cross-sectional view of the split hub assembly of the stationary unipedal cycle apparatus.

FIG. 4 is an cross-sectional view of split hub assembly 100 of stationary unipedal cycle apparatus 10. Hub assembly 100 is capable of providing two modes of operation: bipedal or unipedal mode. The bipedal mode involves the rider pedaling apparatus 10 as one would a traditional bicycle. In this mode, plunger 52 is engaged causing left and right cranks 46 and 48 to be physically connected and positioned 180 degrees from each other. Both left and right drive sheaves 14 and 16 are propelled as a single unit by the downward strokes of each leading leg.

In the unipedal mode, plunger 52 is dis-engaged allowing the left and right pedals 22 and 24 to turn independently. In this mode, the left and right drive sheaves 14 and 16 are likewise propelled independently by the forward downstroke and the aft upstroke of each leg.

Split hub assembly 100 consists of two central thirty millimeter steel axles 60 and 62. Each axle is enclosed by a one-way roller clutch bearing 64 (part number INA HFL 3030), and complimentary radial bearings 82 (part number INA HK 3012) which in turn are housed within drive shaft 56. Left and right drive sheaves 14 and 16 are threaded onto the outside end of drive shaft 56. Each drive shaft is housed within a set of double row angular contact bearings 76 (part number NTN 5210AZZ), which are enclosed within hub housing 51. Hub housing 51 is a custom machined steel housing. Hub housing 51 is attached to diagional cross member 6 via hub bracket 50. Central square cavity 105 is common to each axle. Spring loaded plunger 52 enters through right axle 62 through common cavity 105 to engage left axle 60 when actuated. Thus, left and right axles 60 and 62 may be "connected" or "disconnected" by the manual insertion or retraction of plunger 52 into or out of the left side cavity 105 located along the axis of rotation.

In the unipedal mode, hub assembly 100 is disconnected and plunger 52 rests solely in right axle 62. This permits left axle 60 to rotate independently of right axle 62. Clockwise (forward) rotation of right pedal 24 causes the forward rotation of right crank 48 and right axle 62. With forward rotation of right axle 62, one-way roller clutch bearings 64 engage right drive sheave 16, causing it to also rotate in a clockwise direction. The identical sequence is followed for counterclockwise (forward) rotation of left pedal 22, with the appropriate left side components. With either side, reverse pedaling results in no movement of associated drive sheave 14 or 16. This is a result of one-way roller clutch bearings 64 which "free wheel" when either axle 60 or 62 is rotated in a reverse direction.

In the bipedal mode, split hub assembly 100 is connected by moving plunger 52 forward in central cavity 105 by manually actuating plunger actuator rod 54 so that plunger 52 engages both left and right axles 60 and 62. This action permits both left and right drive sheaves 14 and 16 to rotate together as if axles 60 and 62 were a single unit. In this mode, as with the unipedal mode, roller clutch bearings 64 permit both drive sheaves 14 and 16 to rotate together in the forward direction but do not cause them to rotate in the reverse direction.

Split hub assembly 100 consists of two sets of drawn cup roller clutch bearings 64 that provide the one way rotation of drive shafts 56 on either side. Assembly 100 also contains thrust needle roller bearings 78 (part number Torrington FNTA 3047), radial needle roller bearings 82, double row angular contact bearings 76, thrust washers 80 (part number Torrington FTRA 3047), wave springs 68 (part number Smalley SSR 0162) and 70 (part number Smalley SSB 0354), and retaining clips 72 (Rotoclip Part No. SH-118) and 74 (Rotoclip Part No. HO-354) for each of axles 60 and 62. All components are contained in a single steel housing 50 which is welded directly to the bicycle frame via hub bracket 51.

An electronics module is contained within display console 90. The electronics module reads optically encoded data from spinning flywheels 18 and 20 and spinning axles 60 and 62. This data is then translated into measurements of Power (in Watts), Distance traveled, and Speed (both RPM and miles per hour), which can be displayed via light emitting diodes (LEDs) contained in display console 90. Functioning in an isotonic (same force) resistance mode, the electronics module serves to energize two identical gear motors 38 and 40, which are coupled to two respective brake bands 34 and 36 that are wrapped around respective drive sheaves 14 and 16 allowing resistance to be applied to each leg simultaneously or individually, according to the needs of the rider. The gear motors contain encoders which provide the means for controlling and producing fine rotational movement. Functioning in an isokinetic (same speed) resistance mode, the electronics module maintains the rider's speed by automatically adjusting gear motor's 38 and 40 resistance several times a second. If the rider is pedaling in unipedal mode, the resistance levels for each leg will vary according to the output of each leg such that the same speed is maintained if in an iso-kinetic mode. Appropriate gear levels are also displayed to the user via display console 90 from Level 0 to Level 10. In addition, an elapsed timer circuit provides a resettable clock.

Figure 5A:
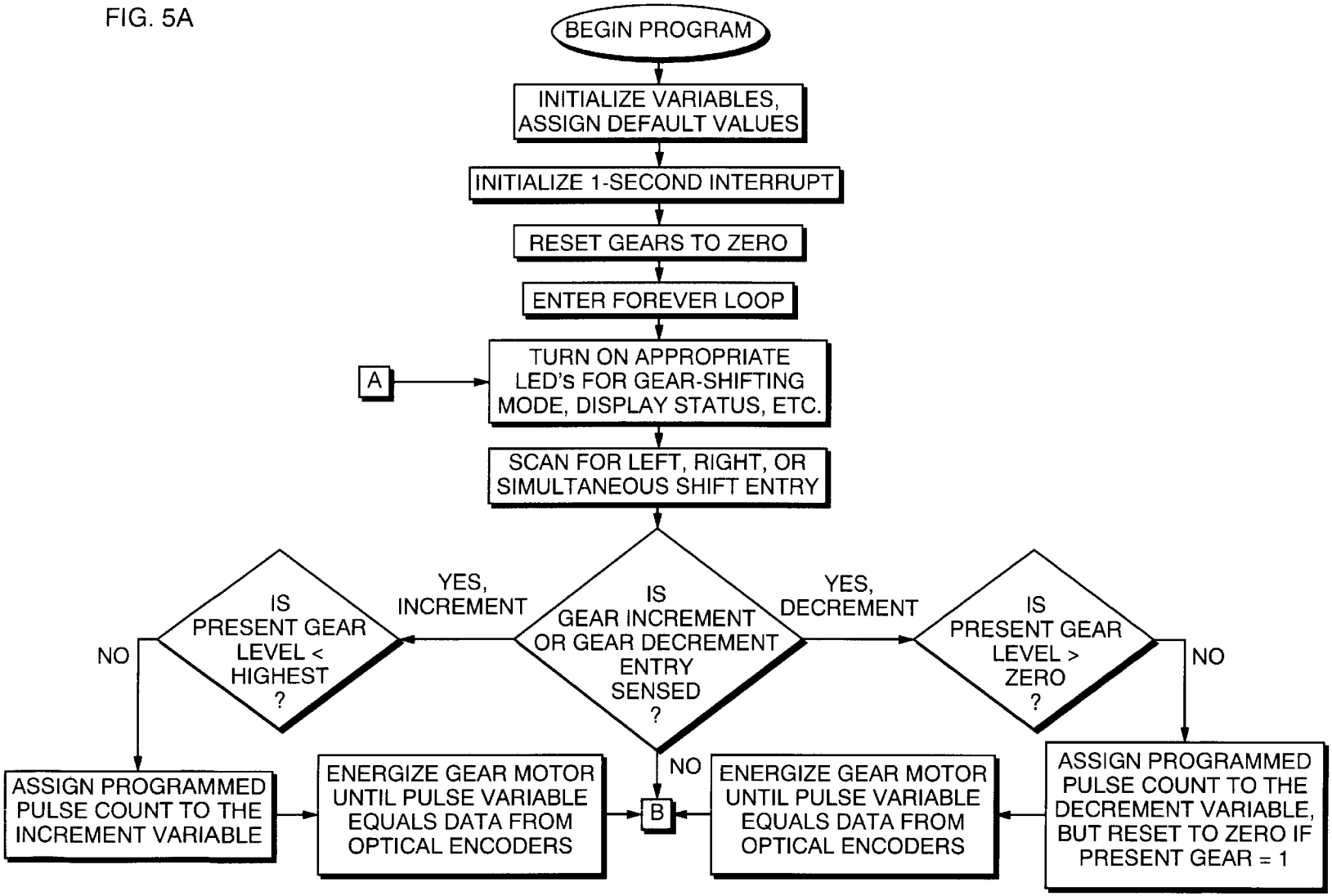
FIGS. 5A–5C illustrate a flow diagram of the software routine run by the electronics module.
Figure 5B:
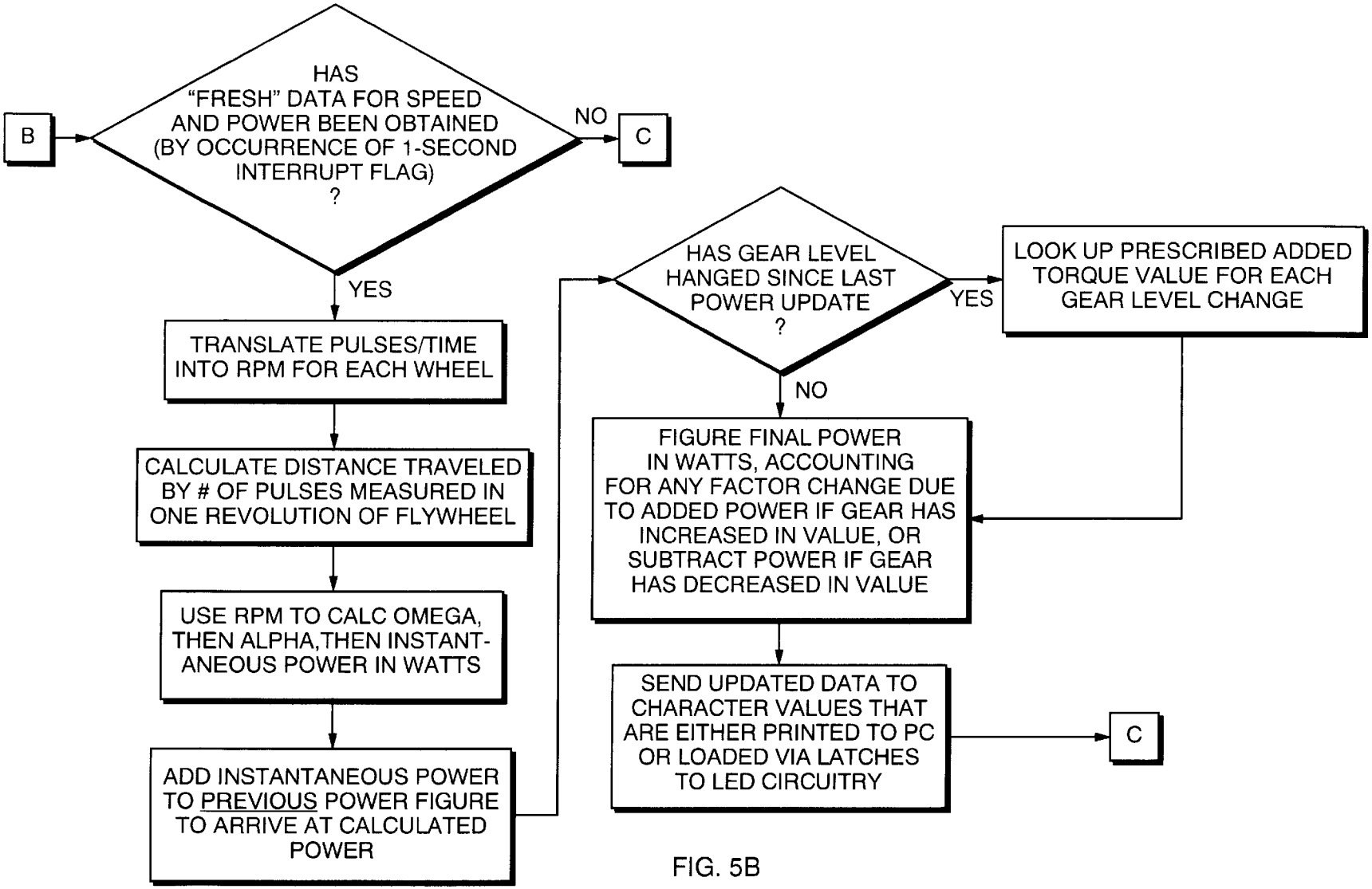
Figure 5C:
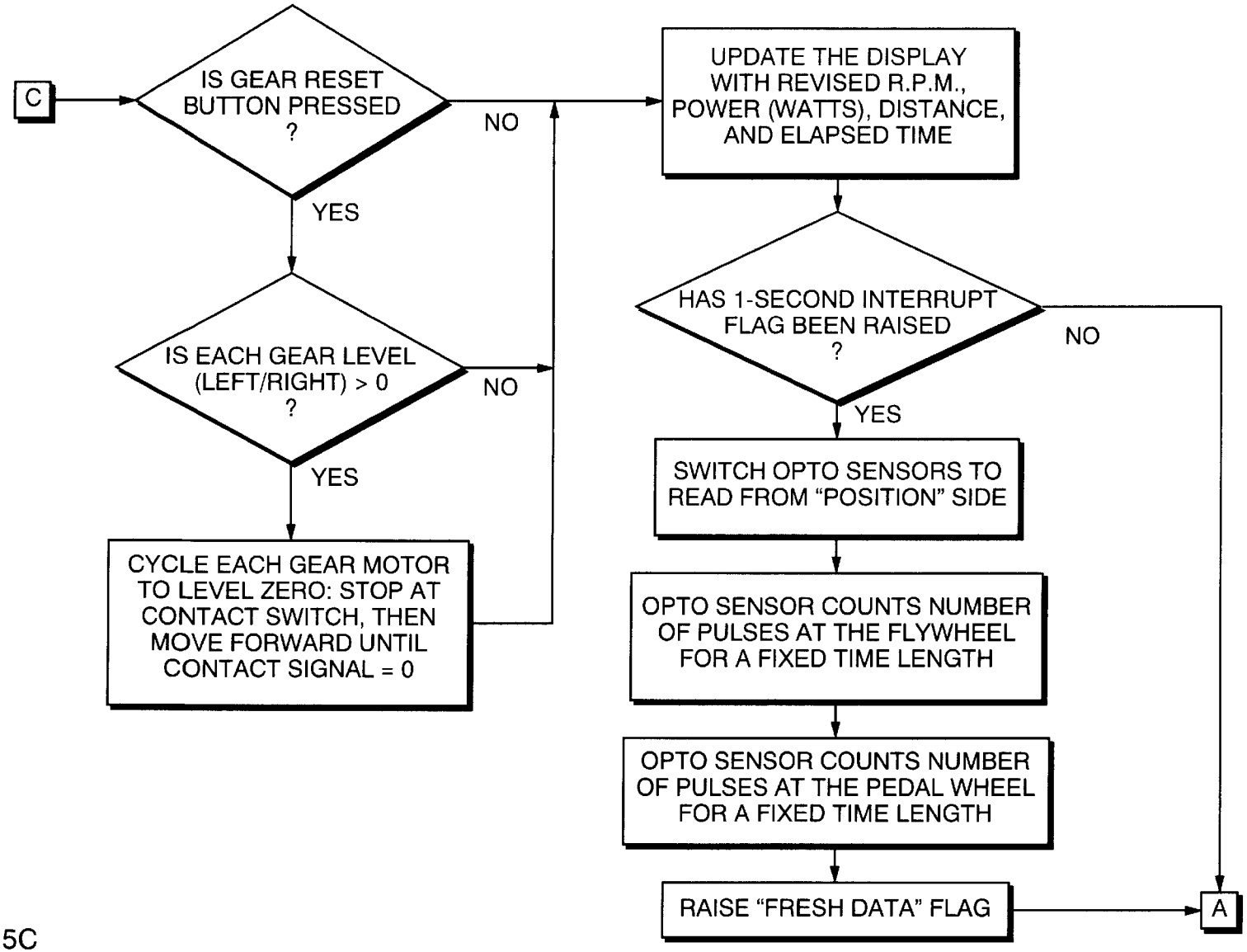

FIG. 5 is a flow diagram of the software routine run by the electronics module. At the heart of the electronics module is the Motorola 68HC11 microprocessor (not shown); 37 I/O ports are utilized to receive pulse data and push-button entries, to energize motors 38 and 40, and to light up LED displays. Software written in C is programmed to run in a while-forever loop. The software continuously polls the I/O ports for user requests.

A software interrupt routine is performed once per second to retrieve data from the opto sensors 63 and 66 located at drive sheaves 14/16 and the opto sensors 65 and 67 located at flywheels 18/20. Once "fresh" data is entered, the Power & Velocity calculations take place. If a gearing operation occurs immediately prior to the 1-second interrupt flag, data is not collected so as not to disturb the motor actuation.

Figure 6:
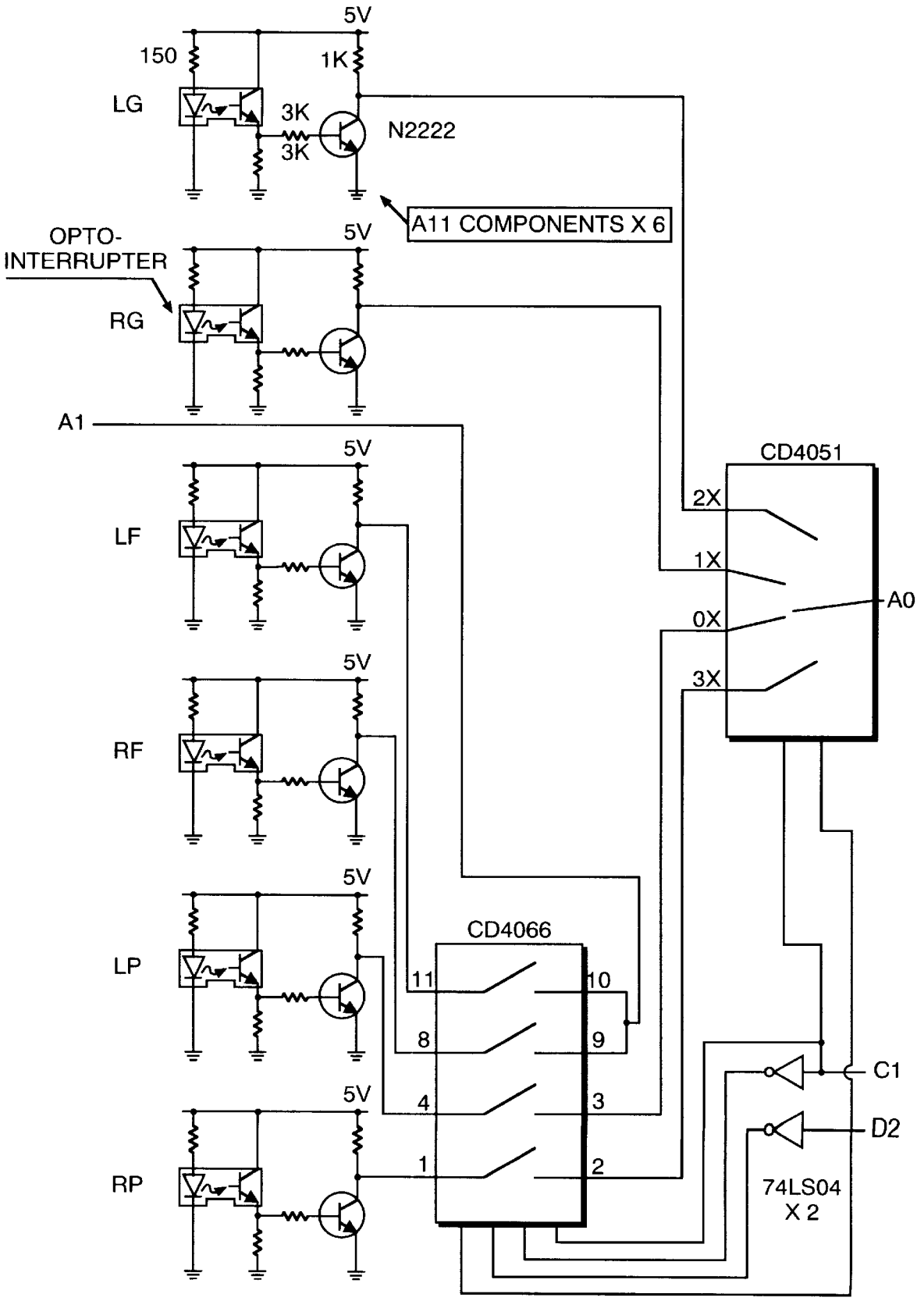
FIG. 6 is the optical encoder circuit used to provide the optical data necessary for the Motorola 68HC11 microprocessor to perform measurement of the user's Power, Distance and Speed values.

FIG. 6 is the optical encoder circuit used to provide the optical data necessary for the Motorola 68HC11 microprocessor to perform measurement of the user's Power, Distance and Speed values. The optical encoder circuit is also used to determine gear levels of apparatus 10 which are visual indicators of reistance levels to each leg. Opto-interrupter sensors (not shown) are mounted to each drive sheave 14 and 16 and each flywheel 18 and 20 in order to provide the optical data to the 6811 microprocessor. The gear levels are determined via optical encoders (not shown) encased within the gear motors. As the motor shaft turns, pulse data is sent to the 6811 microprocessor through the same ports as the Power/Velocity sensors, however, the data is sent through a different channel via a digital switch integrated circuit.

As previously described, four optical encoder disks (two on each side) are used to provide optical data for the on-board electronics via the opto-interrupter sensors; left axle encoder disk 66 is located on the outboard side of left axle 60 while left flywheel encoder disk 67 is located on the outboard side of flywheel 18; and right axle encoder disk 63 is located on the outboard side of right axle 62 while right flywheel encoder disk 65 is located on the outboard side of flywheel 20. Each optical encoder disk consist of a 60-line code that is used to provide the optical data necessary for the electronics module to perform measurement of Power, Distance and Speed.

During the 1-second interrupt, a 0.32 second window is opened for either the left or right side's drive sheave 14/16 and the left or right side's flywheel 18/20 (according to which side has requested data). Sequentially, the number of pulses that are sensed in the allotted time are entered into variables, and manipulated in the main routine to arrive at an RPM value. Next, an instantaneous Power value is calculated by $$P=(I*alpha*omega)$$

where I is the flywheel Moment of Inertia, alpha is the difference in sequential angular velocity measurements, and omega is the current angular velocity in radians/second. This instantaneous Power value is added to all previous Power measurements to arrive at a current total value in watts. Note that in the event of a deceleration, negative Power is added to reduce the overall Power value. In addition, the current gear level is taken into account to increase the added Power by a certain factor related to the amount of added Torque the rider adds to the system via drive sheaves 14/16.

Distance is measured by the number of pulses that are counted continuously through the 6811's pulse accumulator. Knowing the physical parameters of the rotating flywheel allows a direct calculation of tenths of a mile from the number of pulses, assuming a standard 26" diameter wheel is spinning in place of the flywheel. Likewise, Velocity is measured directly from the pulse data in RPM, and converted to miles/hour (mph) via software.

The gear levels of apparatus 10 are likewise determined via optical encoders encased within the gear motors. As the motor shaft turns, pulse data is sent to the 6811 microprocessor through the same ports as the Power/Velocity sensors mentioned above, however, the data is sent through a different channel via a digital switch integrated circuit. The 6811 microprocessor can dictate exactly how far the motor/brake band system rotates (thereby increasing or decreasing resistance) due to the pulse data received from the optical encoders. The lowest gear level (0) is determined by a contact sensor (not shown) mounted directly to the bike frame to act as a limit switch.

Figure 7:
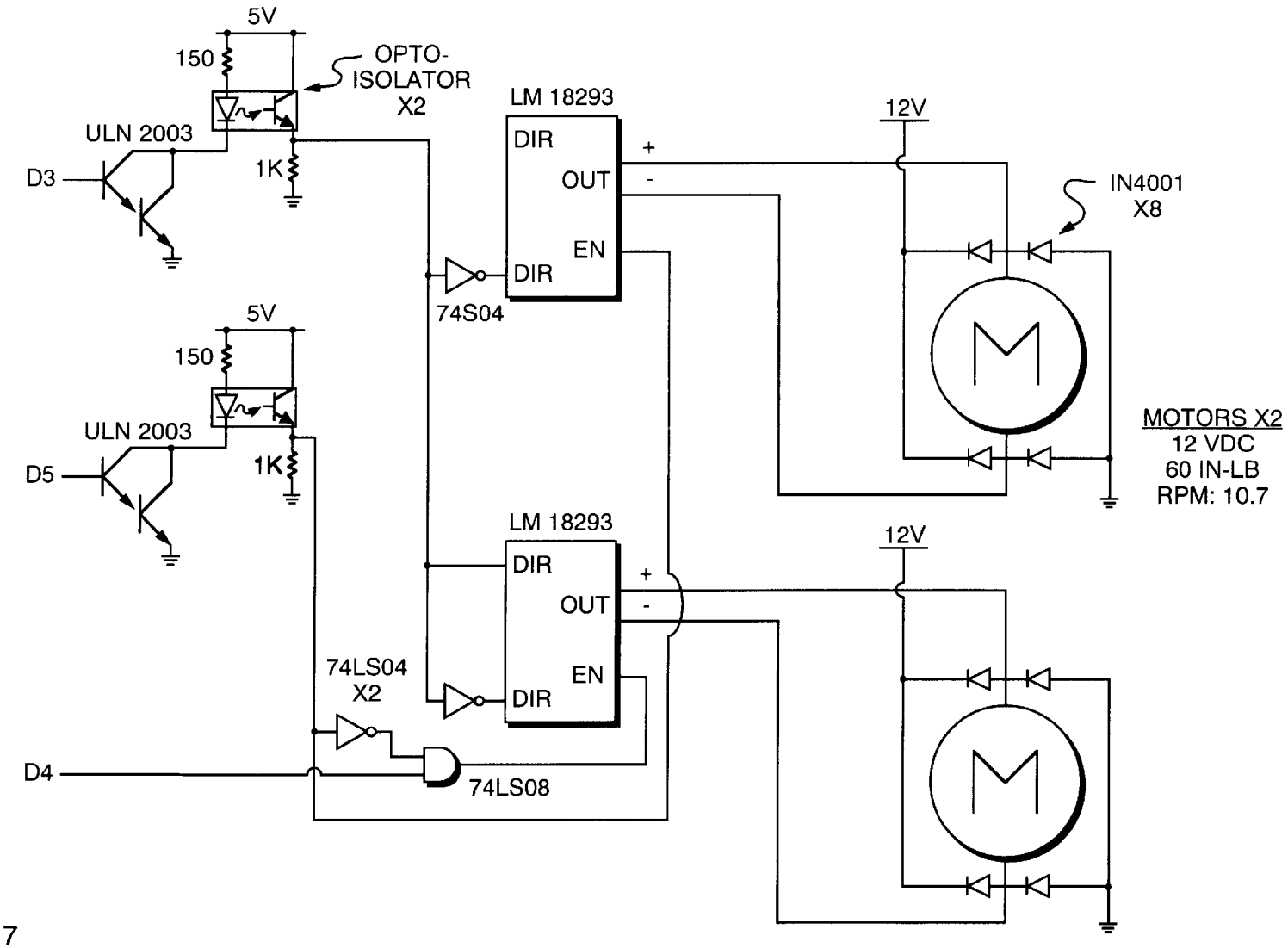
FIG. 7 is the motor driver circuit.

FIG. 7 is the motor driver circuit used by the Motorola 68HC11 microprocessor to provide forward and reverse directional inputs to motors 38 and 40. Motors 38 and 40 are twelve volt DC gear motors having a maximum torque of sixty inches/pound and a constant 10.7 RPM. A driver circuit uses two motor driver (i.e. LM 18293) chips in an H-bridge configuration allowing for forward and reverse directions. No changes to the flywheels would be required in order to reverse pedal but the roller clutches bearings 64 do not permit reverse pedalling and would need to be changed using techniques well known in the art. A user pedalling in a reverse direction adds a different demand profile on the user's muscles being worked. Over-current protection is required.

Figure 8:
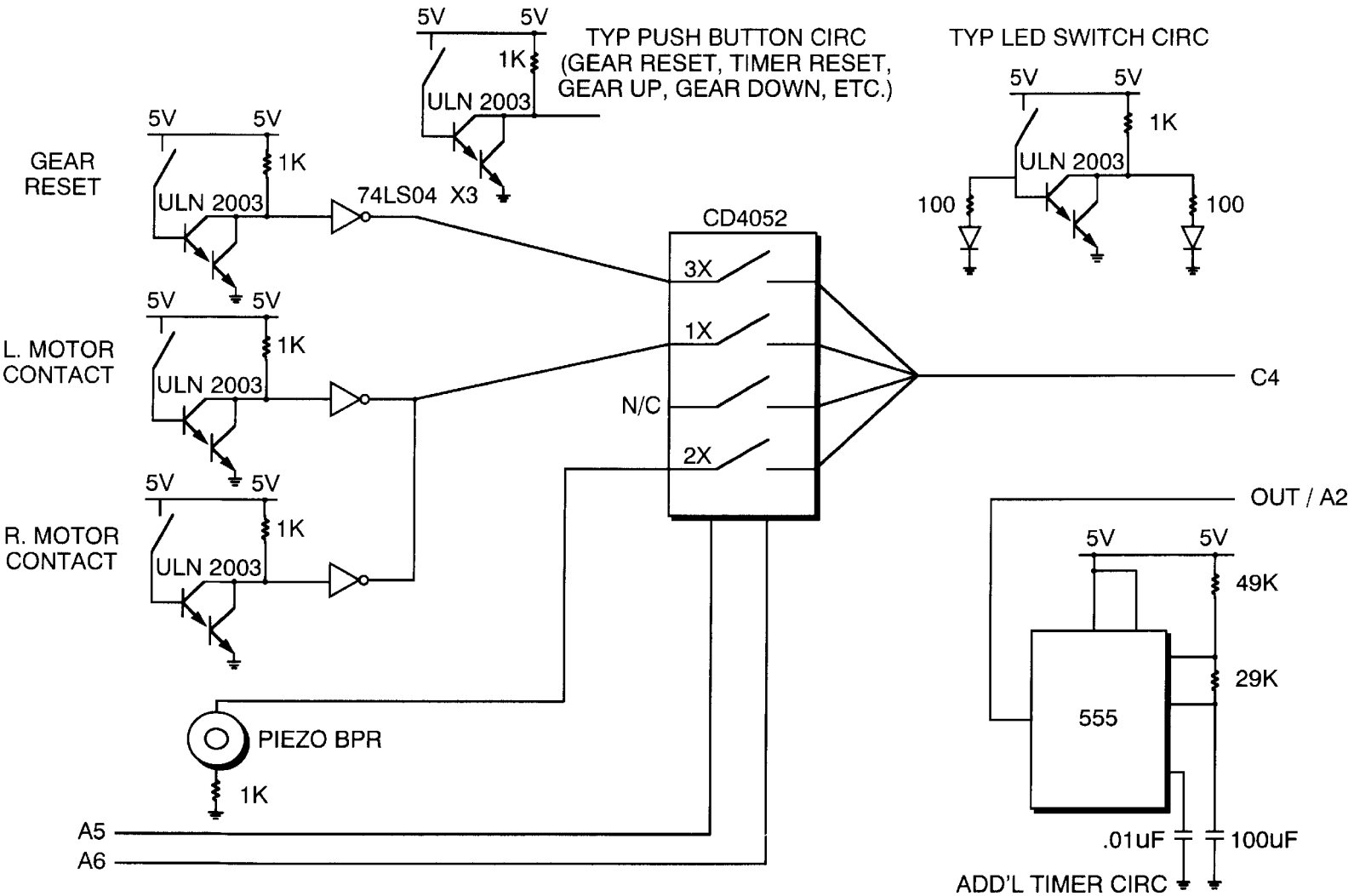
FIG. 8 is the switching circuit utilized to receive push-button entries for rider requests/feature selections.

FIG. 8 is the switching circuit contained within display console 90 and utilized by the Motorola 68HC11 microprocessor to receive push-button entries for rider requests/feature selections. The push-button entry module allows the rider to view Power and Velocity data from either the left or the right side. Other rider entries may include any of the following: Gear UP, Gear DOWN, Gear Reset (to Level 0), Timer Reset, Odometer Reset, Simultaneous Gear Shift, and Individual Gear Shift (L/R).

All data is displayed using numerical format 7-segment standard or 14-segment alphanumeric LED displays. In the 14-segment option, messages are displayed to prompt the rider for entries. These "data windows" display the following: Power (in Watts or Kcal/Hr), Distance Traveled (in miles/km), Elapsed Time, Gear Level (0–10), and Velocity (in RPM or MPH). In addition, LEDs are utilized to indicate the following: Units for Power/Velocity/Distance, BI-Pedal operation, UNI-Pedal operation, Simultaneous Shift Mode, Individual Shift Mode (L/R), and Power On.

The electronics module also incorporates software routines for special program features such as hill-climbing patterns, hill/valley combinations, and other workout routines. These programs are highlighted by LED arrays which keep track of the pace and location of the rider within the routine.

All the electronics of apparatus 10 are powered by a Zenith ZPS-30 watt 12 v/5 v switching power supply capable of two and three amps peak, respectively. This unit is UL listed.

The detail described here is transmutable with other similar components. The Motorola 6811 microprocessor may be replaced with an Intel or other capable microprocessor having any number of I/O ports. Any motor driver chip may be used as long as it is capable of drawing the required current to energize the gear motors. Likewise, gear motors 38 and 40 may be replaced with higher torque-output motors having a different torque ceiling and RPM than that specified herein. The encoders used to collect pulse data may be made with higher (or lower) resolution, depending on the brake band resistance values required. The selected power supply may be replaced by another source having varying 12 v/5 v output values.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A pedal apparatus having a left pedal attached to a left crank and a right pedal attached to a right crank, said apparatus comprising:

a left drive system connected to said left crank and a right drive system connected to said right crank, wherein said left drive system is substantially identical to said right side drive system and wherein a pedalling resistance on said left pedal can be set independently of a pedalling resistance on said right pedal;

control means for providing isokinetic pedaling resistance throughout the cycle of rotation of said pedals.

2. The pedal apparatus of claim 1 further comprising:

a split hub assembly having two central axles, wherein one axle is connected to the left side drive system and the other axle is connected to the right side drive system, said split hub assembly is selectively operable by the user as a bipedal apparatus having said left pedal and said right pedal rotating synchronously.

3. The drive system of claim 1 further comprising:

a left drive sheave connected to said left crank and a right drive sheave connected to said right crank wherein said drive sheaves rotate when said cranks are rotated;

a left drive belt forming a closed loop wherein one end of the loop is wrapped substantially around said left drive sheave and a right drive belt forming a closed loop wherein one end of the loop is wrapped substantially around said right drive sheave;

a left flywheel sheave wherein the other end of the closed loop is wrapped substantially around said left flywheel sheave and a right flywheel sheave wherein the other end of the closed loop is wrapped substantially around said right flywheel sheave; and a left flywheel connected to said left flywheel sheave wherein the rotation of said left crank causes said left flywheel to rotate via said left drive belt and a right flywheel connected to said right flywheel sheave wherein the rotation of said right crank causes said right flywheel to rotate via said right drive belt.

4. The drive system of claim 3 further comprising:

a left idler tensioner connected to said left drive belt wherein said idler tensioner serves to provide continuity between said left drive sheave and said left flywheel sheave by allowing tensioning adjustment to said left drive belt and a right idler tensioner connected to said right drive belt wherein said idler tensioner serves to provide continuity between said right drive sheave and said right flywheel sheave by allowing tensioning adjustment to said right drive belt.

5. The split hub assembly of claim 2 further comprising:

a plunger, and an activation rod wherein the user activates said rod to cause said plunger to lock together said right and left drive assemblies whereby said left pedal and said right pedal rotate synchronously.

6. The split hub assembly of claim 5 further comprising:

left bearings disposed upon the external surface of said left axle and right bearings disposed upon the external surface of said right axle;

a left drive shaft that encloses said left bearings and a right drive shaft that encloses said right bearings; and left contact bearings which house said left drive shaft and right contact bearings which house said right drive shaft.

7. The drive system of claim 3 further comprising:

a left brake system whereby said brake system provides resistance to said left drive system and a right brake system whereby said right brake system provides resistance to said right drive system.

8. The brake system of claim 7 further comprising:

a left friction brake band substantially disposed upon said left drive sheave wherein the tightening of said brake band increases the torque required to rotate said left drive sheave and a right friction brake band substantially disposed upon said right drive sheave wherein the tightening of said brake band increases the torque required to rotate said right drive sheave.

9. The brake system of claim 8 further comprising:

a left gear motor attached to said brake band wherein said gear motor is utilized to vary the resistance of said left drive system by tightening said left friction brake band around said left drive sheave and a right gear motor attached to said brake band wherein said gear motor is utilized to vary the resistance of said right drive system by tightening said right friction brake band around said right drive sheave.

10. The pedal apparatus of claim 1 further comprising:

an electronics module wherein said electronics module independently reads encoded data from said left drive system and from said right drive system, whereby the data is translated into measurements of the user's power, distance traveled and speed.

11. The electronics module of claim 10 reads optically encoded data.

12. The electronics module of claim 11 further comprising an optical encoder circuit having opto-interrupter sensors mounted to each drive wheel, flywheel and gear motor.

13. A pedal apparatus having a left pedal attached to a left crank and a right pedal attached to a right crank, said apparatus comprising:

a left drive system connected to said left crank and a right drive system connected to said right crank, wherein said left drive system is substantially identical to said right side drive system and wherein a pedalling resistance on said left pedal can be set independently of a pedalling resistance on said right pedal;

control means for providing isotonic pedaling resistance throughout the cycle of rotation of said pedals.

14. The pedal apparatus of claim 13 further comprising:

a split hub assembly having two central axles, wherein one axle is connected to the left side drive system and the other axle is connected to the right side drive system, said split hub assembly is selectively operable by the user as a bipedal apparatus having said left pedal and said right pedal rotating synchronously.

15. The drive system of claim 13 further comprising:

a left drive sheave connected to said left crank and a right drive sheave connected to said right crank wherein said drive sheaves rotate when said cranks are rotated;

a left drive belt forming a closed loop wherein one end of the loop is wrapped substantially around said left drive sheave and a right drive belt forming a closed loop wherein one end of the loop is wrapped substantially around said right drive sheave;

a left flywheel sheave wherein the other end of the closed loop is wrapped substantially around said left flywheel sheave and a right flywheel sheave wherein the other end of the closed loop is wrapped substantially around said right flywheel sheave; and a left flywheel connected to said left flywheel sheave wherein the rotation of said left crank causes said left flywheel to rotate via said left drive belt and a right flywheel connected to said right flywheel sheave wherein the rotation of said right crank causes said right flywheel to rotate via said right drive belt.

16. The drive system of claim 15 further comprising:

a left idler tensioner connected to said left drive belt wherein said idler tensioner serves to provide continuity between said left drive sheave and said left flywheel sheave by allowing tensioning adjustment to said left drive belt and a right idler tensioner connected to said right drive belt wherein said idler tensioner serves to provide continuity between said right drive sheave and said right flywheel sheave by allowing tensioning adjustment to said right drive belt.

17. The split hub assembly of claim 14 further comprising:

a plunger, and an activation rod wherein the user activates said rod to cause said plunger to lock together said right and left drive assemblies whereby said left pedal and said right pedal rotate synchronously.

18. The split hub assembly of claim 17 further comprising:

left bearings disposed upon the external surface of said left axle and right bearings disposed upon the external surface of said right axle;

a left drive shaft that encloses said left bearings and a right drive shaft that encloses said right bearings; and left contact bearings which house said left drive shaft and right contact bearings which house said right drive shaft.

19. The drive system of claim 15 further comprising:

a left brake system whereby said brake system provides resistance to said left drive system and a right brake system whereby said right brake system provides resistance to said right drive system.

20. The brake system of claim 19 further comprising:

a left friction brake band substantially disposed upon said left drive sheave wherein the tightening of said brake band increases the torque required to rotate said left drive sheave and a right friction brake band substantially disposed upon said right drive sheave wherein the tightening of said brake band increases the torque required to rotate said right drive sheave.

* * * * *